US005184912A

United States Patent [19]

Bowman et al.

[11] Patent Number: 5,184,912

[45] Date of Patent: Feb. 9, 1993

[54] SPLIT-RING MANHOLE COVER SUPPORT

[75] Inventors: Harold M. Bowman, 18867 N. Valley Dr., Fairview Park, Ohio 44126; George T. Fuller, Chagrin Falls, Ohio

[73] Assignee: Harold M. Bowman, Westlake, Ohio

[21] Appl. No.: 596,255

[22] Filed: Oct. 12, 1990

Related U.S. Application Data

[63] Continuation-in-part of Ser. No. 366,177, Jun. 13, 1989, Pat. No. 4,969,771, and a continuation-in-part of Ser. No. 362,257, Jun. 6, 1989, Pat. No. 4,963,053, and a continuation-in-part of Ser. No. 362,216, Jun. 6, 1989, Pat. No. 4,966,489, and a continuation-in-part of Ser. No. 536,691, Jun. 12, 1990, abandoned.

[51] Int. Cl.[5] ..... E02D 29/14

[52] U.S. Cl. ..... 404/26

[58] Field of Search ..... 404/26, 25; 411/517, 411/518

[56] References Cited

U.S. PATENT DOCUMENTS

| | | | |
|---|---|---|---|
| 1,758,515 | 5/1930 | Heiermann | 411/517 X |
| 1,908,909 | 5/1933 | Manz . | |
| 2,595,787 | 5/1952 | Heimann | 411/518 X |
| 3,701,303 | 10/1972 | Kondo | 411/518 |
| 3,858,998 | 1/1975 | Larsson et al. | 404/26 |
| 3,891,337 | 6/1975 | McCoy . | |
| 4,097,171 | 6/1978 | Fier . | |
| 4,225,226 | 9/1980 | Fier . | |
| 4,302,126 | 11/1981 | Fier . | |
| 4,582,450 | 4/1986 | Neil | 404/26 |
| 4,614,065 | 9/1986 | Papp | 404/26 |
| 4,987,650 | 1/1991 | Eickmann | 411/517 X |

FOREIGN PATENT DOCUMENTS

| | | | |
|---|---|---|---|
| 3910887 | 5/1990 | Fed. Rep. of Germany | 411/517 |
| 0434471 | 2/1949 | Italy | 411/517 |
| 0013125 | 11/1941 | Sweden | 411/517 |
| 0886005 | 1/1962 | United Kingdom | 411/518 |

*Primary Examiner*—Ramon S. Britts
*Assistant Examiner*—Nancy Connolly
*Attorney, Agent, or Firm*—Watts, Hoffmann, Fisher & Heinke

[57] ABSTRACT

The grip of the collar element of an existing circular manhole cover-supporting structure, such as a circular manhole frame, on a split-ring style expansion-joint-fitted manhole cover support inserted into, surrounded by, and forced by expansion against said collar element is improved by having selective stiffener means disposed in a sector of the cover support that is generally opposite to the expansion joint thereof, the stiffener means suppressing the tendency of the corresponding sector of the base ring to pull away from the collar element.

29 Claims, 2 Drawing Sheets

SPLIT-RING MANHOLE COVER SUPPORT

REFERENCE TO OTHER APPLICATIONS

This patent application is a continuation-in-part of the following patent applications, Serial Nos.: Ser. No. 07/366,177 filed Jun. 13, 1989, entitled "Manhole Cover Support Having Enhanced Grip", now U.S. Pat. No. 4,969,771; Ser. No. 07/362,257 filed Jun. 6, 1989, entitled "Multicomponent Wales and Bases for Manhole Cover Supports", now U.S. Pat. No. 4,963,053; Ser. No. 07/362,216 filed Jun. 6, 1989, entitled "Manhole Cover Support Having Interbraced Top Members", now U.S. Pat. No. 4,966,489 and Ser. No. 07/536,691 filed Jun. 12, 1990, entitled "Manhole Cover Support With Spanners", now abandoned; and it is also a continuation-in-part of my recently-filed application entitled "Support for a Catch Basin Cover,". It also is related to the following U.S. Pat. Nos.: 4,834,574, 4,867,600, 4,867,201, 4,872,780 and 4,927,290. The teachings of these applications and patents are incorporated herein by reference.

BACKGROUND OF THE INVENTION

This invention relates to split-ring manhole cover supports and more particular to such cover supports that are capable of being gripped more tightly by an existing manhole cover-receiving structure (such as a manhole frame) than are conventional split-ring manhole cover supports.

For simplicity the term "existing manhole cover-receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used in this application to refer to a removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered usually is a utility enclosure serving, e.g., an electric, gas, water, sewer or storm drainage system.

The preponderance of manholes are circular (in street plan), have circular covers and have existing cover-receiving structures such as frames that have circular access holes, circular sills to support the cover, and circular lateral cover keepers (the latter also sometimes termed "collars"). Accordingly, this specification is directed to generally round manhole cover supports that have ring-like annular elements which are adapted to interact with an existing round manhole cover-receiving structure.

Ordinarily a cover support finds its use when a roadway such as a street or highway is resurfaced with an added layer of paving material or repaved, typically with asphalt concrete or sheet asphalt, to establish a higher grade than immediately before. A principal use for the instant cover support is expected to be in a municipality where axle loads up to 18,182 kg. may have to be resisted by many of these cover supports (as well as serious impact loads from vehicles and snow plows plus a variety of temperature effects, steam leaks, spillage, etc.) without permitting a hazardous dislocation of the cover support or its cover. Often it is desirable also to cushion the cover for resisting wear or reducing noise, and/or to seal the cover and its cover support against a substantial and possibly overloading infiltration of surface water, e.g., storm drainage that otherwise would enter a sanitary sewer system at various manhole locations.

The conventional split ring cover support today has a base ring that is practically uniform in its cross section. Perhaps the least expensive manhole cover support for a circular manhole is a conventional split-ring cover support like the one invented by A. H. R. McCoy. It is disclosed in U.S. Pat. No. 3,891,337 of Jun. 24, 1975, and shows a screw-operated expansion joint, the screw working against the reaction of an abutment projecting from the inside of the base ring. Related ones with various sorts of joint expander means for the split base ring have been developed since then, e.g. the Fier U.S. Pat. Nos. 4,097,171; 4,225,226; and 4,302,126 which show a conventional turnbuckle acting on pivotal eye bolts for the expansion joint and some lever-operated expansion joints, i.e., ones with a spreading link or a pivotally-mounted spreading toggle mechanism.

The force required for physically pulling out vertically a nominally 23-inch steel expansible split ring cover support from a steel manhole frame in which it was very forcefully expanded I found to be 1200 pounds in an actual test. In the test the frame collar was 23¼ inches in diameter at the bottom, 23¾ inches at its top and an inch high; the vertical cross section of the base ring of the cover support was uniformly ¾-inch thick and one-inch high.

Contrary to expectations the expansion of the base ring of this cover support resulted in tension at the inside periphery of the base ring over quite a large sector of said ring. The ring was expected to be in very high pressure (strong) contact with the frame collar over a fairly large area thereof, the force supplied by the screw means that expanded the base ring spreader being quite high. However, said tension indicated a slight bending of the ring towards its center. Such bending was particularly pronounced and centered opposite to the base ring gap being spread by the screw-operated spreader of the cover support, i.e., opposite to the expansion joint of the split base ring.

The most powerful thrust of the base ring of the tested cover support against the collar of the frame actually occurred in two fairly small sectors, one on each side of spreader; these sectors amounted to roughly no more than about 85°-90° together. The condition of least pressure of the base ring against the collar (the bending inwards) in said about 85°-90° sector was centered in the base ring diametrically opposite to the spreader; this condition was more pronounced in the 60° middle of this sector and even more yet in the 30° middle of such sector. Such sectors which subtend an angle less than 90° are termed "acute sectors" in this application.

An advantage of the present invention over conventional split-ring manhole cover supports includes the ability of the installer to develop a stronger frictional contact (grip) of the collar of the existing cover-supporting structure on the base ring of such inventive cover support than was ever possible before with conventional split ring cover supports. This lessens the likelihood of displacement of the new cover support in service. Additionally, this improved grip can be further enhanced more broadly by the use of a retention component, e.g., a film or deposits or other surfaces comprising polymer having a high coefficient of friction and developing much friction when it is interposed between the film or the deposits are the outer periphery of said base ring and the inside of said collar.

A further advantage of the present invention is the simplicity with which it can be fashioned to hold the manhole cover at a slight tilt to better conform said emplaced cover to the possible increased slope of the new paving from its edge towards its crown after resurfacing or repaving, this while developing a desired selective stiffening in the base ring.

BROAD STATEMENT OF THE INVENTION

The instant invention is an improvement in a split ring manhole cover support adapted to raise the grade of a manhole cover from a position of retention by the cover seal element and the collar element of an existing manhole cover-supporting structure to a new and higher grade and there retaining it.

The conventional split-ring cover support comprises a base ring that is adapted to fit into and be expanded against the collar element of the existing cover-supporting structure, said base ring, having a top that is essentially in one plane for support of the cover, a bottom therebelow that is in another plane, a spreadable interruption in its essentially circular continuity, spreader means for widening said interruption and thereby forcing said base ring against the restraint of the collar element of said existing cover-supporting structure, and a cover keeper that is connected to and extends upwardly from the outer periphery of the base ring. The improvement comprises a stiffener means for selectively stiffening a sector of the cover support relative to the stiffness of the rest of said cover support, said sector being prone, except for said stiffener means, to lose base ring pressure against said collar element when said interruption in the base ring is widened by said spreader means. Stiffness here means resistance to bending, and stiffness of the base ring here means its resistance to bending away from said collar element when the gap in the ring is spread, this resistance being imparted to the base ring by the ring itself and/or by some other element or elements of the cover support.

BRIEF DESCRIPTION OF THE DRAWINGS

In FIG. 8 short horizontal ribs stiffen the keeper selectively in said sector, thus stiffen the base ring.

In FIG. 9 the base ring is thickened in said sector, and some of the base ring has been removed by a chamfer to moderate the resulting stiffness of the thickened sector;

In FIG. 10 a small, short stiffening member (stiffener) is affixed to the inside of the base ring in said sector;

In FIG. 11 the cover keeper is thickened in said sector where it renders the base ring selectively stiffer; and In FIG. 12 there is shown in said sector a thickened portion of a heavy strap wale that goes clear around the upper periphery of the cover keeper except for the aperture area of the adjustable joint of the base ring. The selective thickening of the wale in said sector renders the corresponding sector of the base ring somewhat stiffer than the rest of the base ring.

BEST MODES FOR CARRYING OUT THE INVENTION

Figure 1:
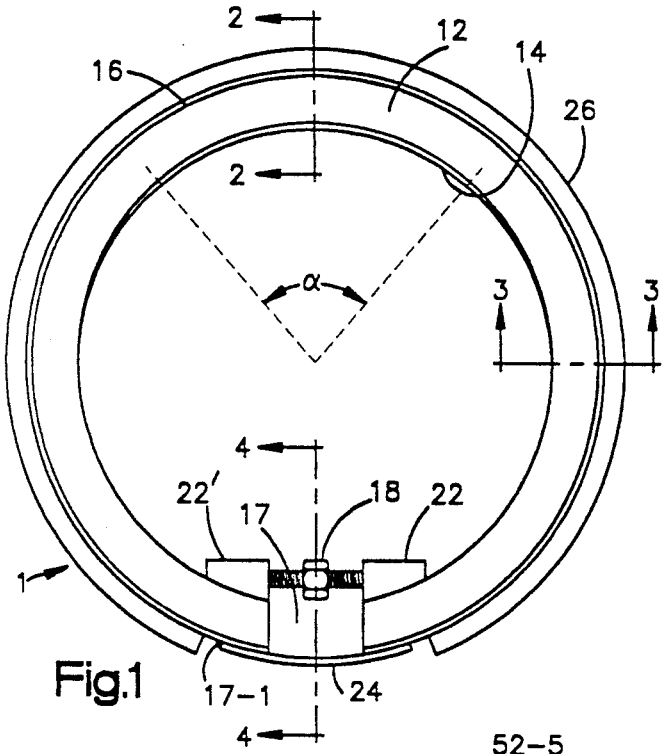
FIG. 1 is a plan view of an embodiment of the inventive cover support wherein the base ring is thickened slightly in a sector opposite the expansion joint, thus stiffening that sector of said ring.
Figure 2:
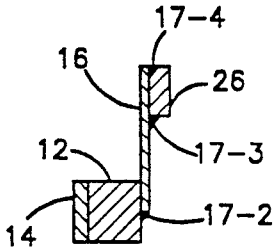
FIG. 2 is a vertical cross-section of FIG. 1 taken through section 2—2.
Figure 3:
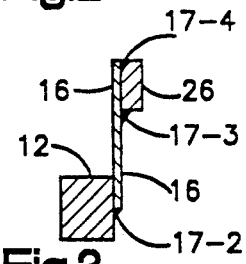
FIG. 3 is a vertical cross-section of FIG. 1 taken through section 3—3.
Figure 4:
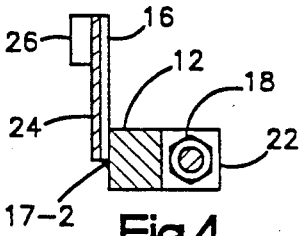
FIG. 4 is a vertical cross-section of FIG. 1 taken through section 4—4.

Referring to FIGS. 1–4, the split-ring cover support for a nominally 30-inch diameter manhole cover, with a selectively stiffened sector $\alpha$ (about 60°) of its base ring 12, is denoted broadly by arrow 1.

Base ring 12 is of cast ductile iron 1 inch high and $\frac{3}{4}''$ wide. Rising from ring 12 and welded thereto by weld 17-2 is the cover keeper 16 of 13 ga. sheet steel. Welded to keeper 16 by welds 17-3 and 17-4 is a solid, uniform steel wale 26, about 3/16" thick by $\frac{3}{4}''$ deep. In the sector $\alpha$ of the base ring there is a thickening piece 14 of steel, a thin crescent about as high as base ring 12, $\frac{1}{8}''$ thick at its center, then tapering to zero at 2 inches beyond each side of the sector; it is welded to the base ring 12.

Alternatively and preferably the base ring 12 can be homogeneously cast in cast ductile iron to be selectively thicker in the sector $\alpha$ in lieu of using piece 14. Also alternatively, a stiffening strap of steel (not shown) stiffer than the cast ductile iron of base ring 12 can be fitted flush into the top and/or bottom of base ring 12 in sector $\alpha$ and there attached as by heavy bolts or welding.

Adjustment of the periphery of the base ring 12 in a manhole frame (not shown) is done by turning turnbuckle nut 18; it is oppositely threaded into cast ductile iron receivers 22 and 22' to spread out or draw in the gap 17 between the ends of ring 12. Receivers 22 and 22' are of cast ductile iron cast integrally with ring 12. Steel flap 24 is welded to keeper 16 on the left side of gap 17 and slides over the keeper 16 on the right side of gap 17; it acts as a shield at the joint. The manhole cover (not shown) is to be seated on the top of base ring 12 and is to be retained laterally by keeper 16. A sealing gasket (not shown) can be used under the cover. The base ring can have conventional elevating screws (not shown) in its bottom to raise the ring or a part of it.

Conventional hold-down means (not shown) e.g., a plurality of hooks attached to the inside periphery of the base ring 12 and extending downwards, are to be fastened to a fixed part of the existing manhole construction (such as the hooks drawn up tight under the sill of a manhole frame as is shown in my U.S. Pat. No. 3,773,428).

Figure 5:
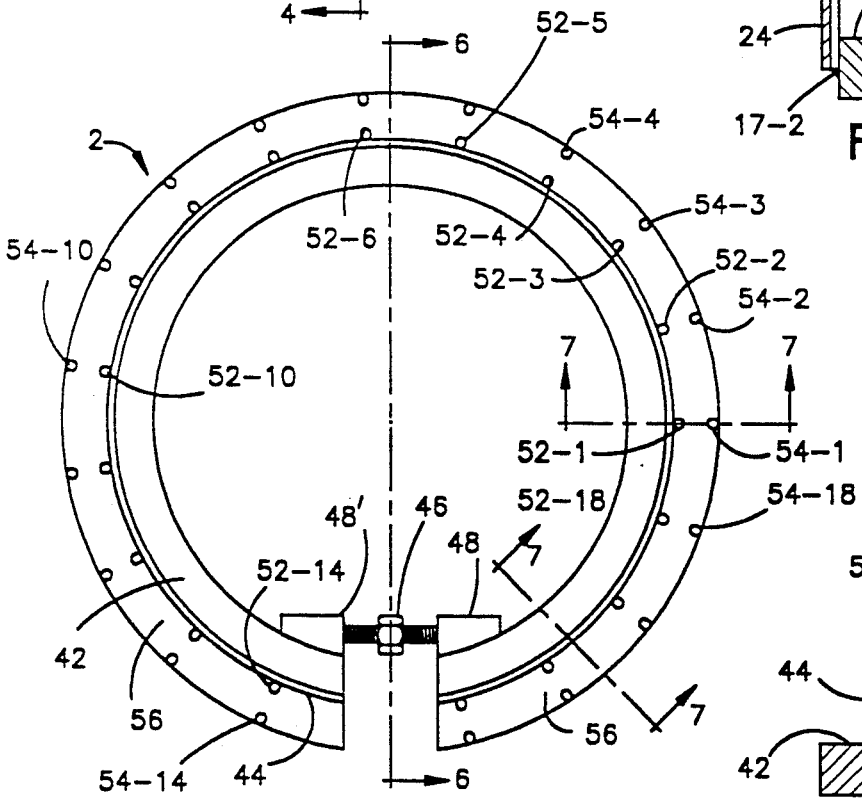
FIG. 5 is a plan view of another embodiment of the inventive cover support wherein the top of the base ring slopes from opposite the expansion joint downward toward said joint area. The bottom of the base ring is horizontal. In effect the base ring is basically a low, truncated cylindrical annulus interrupted at the low point of its wall by an adjustable joint. Where repaving or resurfacing will result in a steeper than original slope from road edge to road crown, this sort of cover support can compensate for that. Thus, it can conform the final cover slope to the actual resulting roadway slope as well as selectively stiffening the base ring opposite to the expansion joint.
Figure 7:
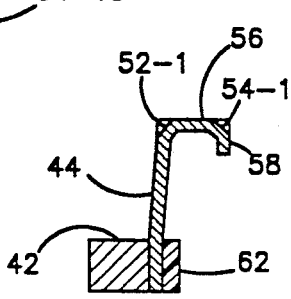
FIG. 7 is a vertical cross section of FIG. 5 taken through section 7—7.
Figure 6:
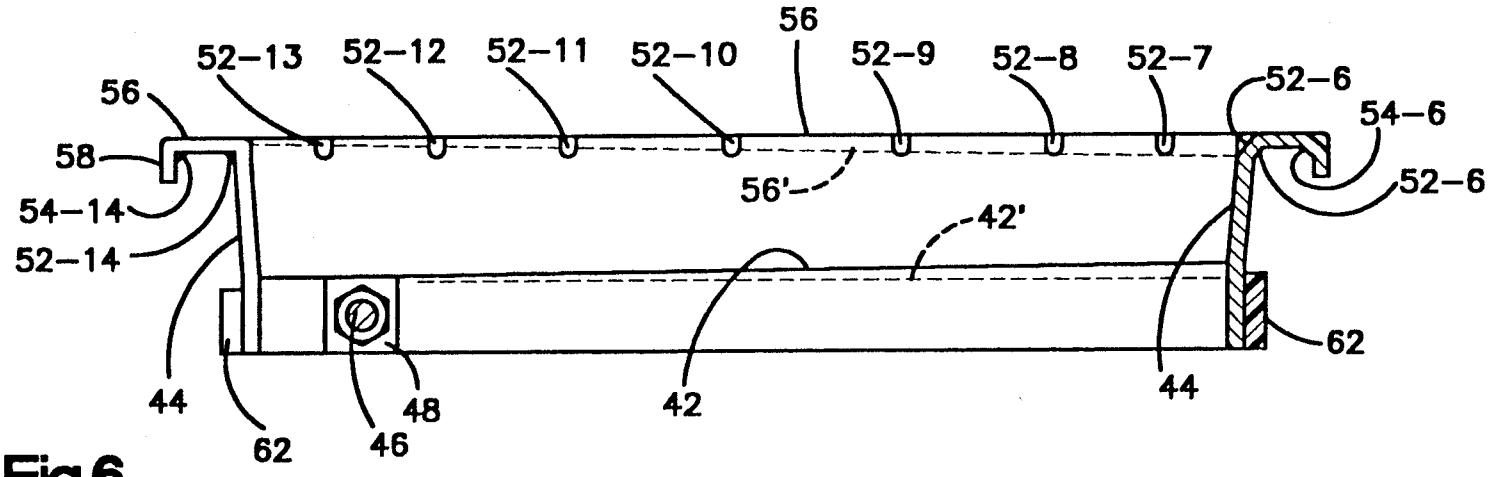
FIG. 6 is a vertical cross section of FIG. 5 taken through section 6—6.

Referring to FIGS. 5–7, the base ring 42 is of the same size and material as was base ring 12 of FIG. 1. Dotted line 42' is horizontal and is simply to emphasize the slight upward slope of the top of the base ring 42 toward its part that is diametrically opposite the gap spanned by the turnbuckle bolt 46'. The turnbuckle adjusting bolt 46' and receivers 48 and 48' are like those of FIG. 1, specifically those items 18, 22, and 22' of FIG. 1.

Arising from ring 42 is keeper 44; it is slightly frustroconical upwards of the base ring 42. The keeper 44 has a slightly sloping flange 56 at its top, then the flange is bent down around its outside edge to form lip 58. Dotted line 56' is horizontal and is simply to emphasize the slight upward slope of the flange 56 toward its part diametrically opposite the gap spanned by turnbuckle bolt 46'. Around the outside of ring 42 is an adhering band 62 of friction-developing material, an about 1/10-inch thick, a flexible, tough baked-on vinyl plastisol about an inch in height.

All around the bend where the top of the keeper 44 is flanged out to make flange 56 there are eighteen substantially evenly-spaced 45°-sloped gussets numbered 52-1, 52-2 and so on, finally to 52-18. All around the bend where the lip 58 bends down from flange 56 are eighteen essentially opposed gussets of the same size and numbered 54-1, 54-2, and so on, finally to 54-18. To avoid clutter only representative 52- and 54-designated gussets are numbered here and around the outside of flange 56. All the gussets are indentations pressed into the 13 ga. sheet steel and are about 0.3" deep inside and about 0.5" long on their inside slants (their troughs). The gussets stiffen and brace the flange and the lip thereon against bending down. The sets of gussets do not have to be opposite to each other or always evenly spaced to be functional.

The base ring 42, on which the manhole cover (not shown) rests, slopes down to the zone of the turnbuckle bolt from the diametrically opposite part of the base ring, i.e., from the right to the left in FIG. 6.

Figure 12:
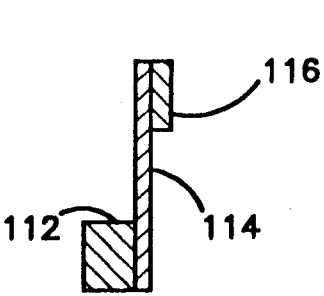
FIGS. 8, 9, 10, 11 and 12 are vertical cross sections of other embodiments of the present split-ring manhole cover support, each taken through a selectively stiffened sector of such cover support that is 180° from the center of the aperture (gap or interruption) in the base of the split ring.
Figure 11:
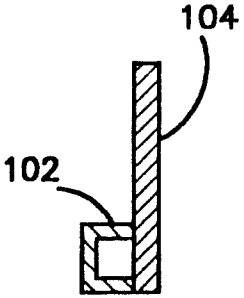
Figure 10:
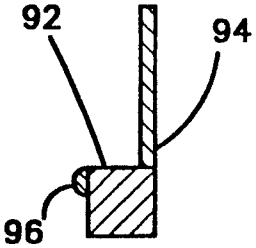
Figure 9:
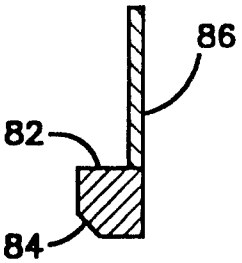
Figure 8:
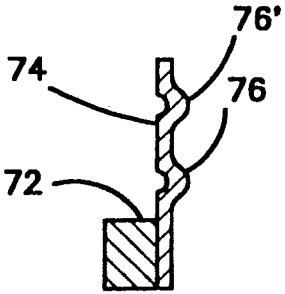

In FIG. 8 the 8-inch long horizontal ribs 76 and 76' in 14 ga., 25-inch outside diameter sheet steel keeper 74 stiffen the of steel base 72 opposite the split therein. Steel base 82 of FIG. 9 is rendered a bit less stiff by chamfer 84 opposite the split in the base, but the sector so chamfered is stiffer and thicker than the rest of the base 82. In FIG. 10 a similar stiffened sector of steel base 92 is made by the 8-inch horizontal welt 96 welded to base 92. Box member base 102 of FIG. 11 has its similar sector stiffened by a corresponding ⅛-inch thickening in welded-on steel keeper 104 in that sector opposite the split in the base ring 102. In FIG. 12 the sector of steel base 112 is selectively stiffened by ⅛" thickening in the corresponding sector of steel wale 116 opposite the split in the base ring 112. The wale is essentially contiguous with the top of 13 ga. sheet steel keeper 114. In some cases the wale (⅛ to ¼" wide and about 1 inch deep) need not be thickened at all or at least thickened as much in the selectively stiffened sector when the same base ring stiffening can be effected by heat treating the steel of the wale to temper and stiffen it selectively in the desired sector. The same metallurgical stiffening can be done to a base ring itself and/or to a keeper, or to all three such elements to effectively stiffen the base ring.

Suitable frictional components and sealants for this service include flexible, often somewhat elastomeric, sometimes slightly foamed resinous materials such as rubbery polymers, natural rubber (itself a polymer), cork and cork-filled flexible sheeting, asphalt, pitch, various polymers such as polyvinyl chloride (preferably as a baked-on plastisol), polyurethane resins, epoxy resins, styrene-containing polymers such as butadiene-styrene, butyl rubber, polyvinyl acetate-polyethylene-acrylate copolymers, and water-resistant ionomers. Advantageously the Shore A hardness of such material will be between about 20 and about 55 and preferably about 45–55.

Modifications and variations of the invention will be apparent to those skilled in the art in the light of the foregoing detailed disclosure and drawings. Therefore, it is to be understood that, with the scope of the appended claims, the invention can be practiced otherwise than shown and described.

We claim:

1. In a split ring manhole cover support adapted to raise the grade of a manhole cover from a position of retention by the cover seat element and the collar element of an existing manhole cover-supporting structure to a new and higher grade and there retaining it, the split ring manhole cover support comprising a base ring that is adapted to fit into and be expanded against the collar element of the existing cover-supporting structure, said base ring, having a top that is essentially in one plane for support of the cover, a bottom therebelow that is in another plane, a spreadable interruption in its essentially circular continuity, spreader means for widening said interruption and thereby forcing said base ring against the restraint of the collar element of said existing cover-supporting structure, and a cover keeper that is connected to and extends upwardly from the outer periphery of the base ring, the improvement for increasing the grip of said collar element on said base ring which comprises:

stiffener means for selectively stiffening a sector of the base ring generally opposite to said spreadable interruption relative to the stiffness of the rest of said base ring, said sector being prone, except for said stiffener means, to lose base ring pressure against said collar element when said interruption in the base ring is spread by said spreader means.

2. The split-ring manhole cover of claim 1 wherein the base ring and/or the keeper comprise metal, and at least a portion of the selective stiffening of said stiffener means is provided by a metallurgical difference between the metal of the stiffener means and that of the rest of the metal of the base ring and the keeper.

3. The split-ring manhole cover support of claim 2 wherein at least a portion of the stiffening of said stiffener means is provided by deformation of part of said metal.

4. The split-ring manhole cover support of claim 1 wherein the stiffener means is part of the base ring.

5. The split ring manhole cover support of claim 1 wherein the stiffener means is part of the keeper.

6. The split ring manhole cover support of claim 1 wherein the stiffener means projects outwardly from the keeper.

7. In a split ring manhole cover support adapted to raise the grade of a manhole cover from a position of retention by the cover seat element and the collar element of an existing manhole cover-supporting structure to a new and higher grade and there retaining it, the split ring manhole cover support comprising a base ring that is adapted to fit into and be expanded against the collar element of the existing cover-supporting structure, said base ring comprising ferrous metal, having a top that is essentially in one plane for support of the cover, a bottom therebelow that is in another plane, a spreadable interruption in its essentially circular continuity, spreader means for widening said interruption and thereby forcing said base ring against the restraint of the collar element of said existing cover-supporting structure, and a cover keeper that is connected to and extends upwardly from the outer periphery of the base ring, the improvement for increasing the grip of said collar element on said base ring which comprises:

a selective stiffener as a part of the cover support, said stiffener being disposed in a sector of the cover support that is generally opposite to said interruption in the base ring, said stiffener rendering an acute sector of the base ring opposite to said interruption more resistant to bending away from the collar element than is the remainder of the base ring when said ring is expanded.

8. The split-ring cover support of claim 7 wherein the stiffener comprises a thickened portion of the base ring, the keeper, or an element projecting outwardly from the keeper.

9. The split-ring cover support of claim 7 wherein the plane of the bottom of said base ring is essentially horizontal, the stiffener is part of the base ring, the central portion of the top of said acute sector of the base ring is higher than the top of said interruption, the plane of the top of the base ring slopes evenly from said central portion to the center of the interruption, and it is oblique to the plane of the bottom of the base ring.

10. The split-ring cover support of claim 7 wherein at least part of the stiffener near its center is attenuated to lessen the stiffness of said acute sector, but still to leave said acute sector stiffer than is the remainder of the base ring.

11. The split-ring cover support of claim 7 wherein said stiffener spans a sector of the base ring that is between about 10° and about 85°.

12. The split-ring cover support of claim 11 wherein said sector is about 15°–45°.

13. The split-ring cover support of claim 11 wherein the cross section of the base ring in at least said sector thereof is essentially rectangular.

14. The split-ring cover support of claim 11 wherein the cross section of the base, ring in at least said sector thereof has a stiffening rib across the inside wall of said ring.

15. The split-ring cover support of claim 7 wherein said base ring comprises ferrous metal, and the keeper comprises sheet steel.

16. The split-ring cover support of claim 15 wherein the keeper is 10–18 ga. steel, its top is flanged outward, and the resulting outward bend is equipped with a succession of gussets.

17. The split-ring cover support of claim 16 wherein the top of the keeper is flanged outward, then bends downward, there are gussets in both the resulting outward and downward bends, and the long axes of the gussets slope at about 45° to said outward flanged part of the keeper top.

18. The split-ring cover support of claim 15 wherein there is a metal wale attached to the keeper, said wale projecting outwardly and downwardly from the top of the keeper, being substantially wider than the thickness of the keeper metal, and extending downward for a distance that is substantially greater than the thickness of the keeper metal.

19. The split-ring cover support of claim 18 wherein the wale is a box member.

20. The split-ring cover support of claim 18 wherein the wale is solid metal.

21. The split-ring cover support of claim 7 wherein the spreader means is screw-operated.

22. The split-ring cover support of claim 7 wherein the spreader means comprises a turnbuckle.

23. The split-ring cover support of claim 7 wherein a frictional component is interposed between said base ring and said collar element.

24. The split-ring cover support of claim 23 wherein the frictional component adheres to the base ring.

25. The split-ring cover support of claim 23 wherein the friction-developing material comprises a polymer.

26. A split-ring cover support adapted to raise the grade of a manhole cover from a position of retention by the cover seat element and the collar element of an existing manhole cover-supporting structure to a new and higher level and there retaining it, said cover support comprising:

a base ring that comprises ferrous metal and is adapted to fit into and be expanded against said collar element, said base ring having a top in one plane for support of the cover, a bottom therebelow that is in another plane, a spreadable interruption in its circumference, screw means for spreading said interruption and thereby forcing said base ring against the restraint of said collar element, said base ring also having a selective stiffener at a locus in the ring that is generally opposite to said interruption, said stiffener rendering the base ring more resistant to bending away from said collar element than is the remainder of the base ring; and a sheet steel cover keeper that is integral with and extends upwardly from the outer periphery of the base ring.

27. The split-ring cover support of claim 26 wherein the base ring comprises cast ductile iron, and the keeper comprises 10–18 ga. steel.

28. The split-ring cover support of claim 26 wherein the screw means comprises a turnbuckle bolt.

29. The split-ring cover support of claim 26 wherein the stiffener in the base ring spans a sector of the base ring that is about 15°–60°.

* * * * *